US005657586A

United States Patent [19]

Bezler et al.

[11] Patent Number: 5,657,586

[45] Date of Patent: Aug. 19, 1997

[54] METHOD AND APPARATUS FOR SUPPORTING A TOMBSTONE

[75] Inventors: Otto Bezler, Middle Village; Joseph D'Alto, Brooklyn, both of N.Y.

[73] Assignee: All Mighty Building Products, Inc., Middle Village, N.Y.

[21] Appl. No.: 578,865

[22] Filed: Dec. 27, 1995

[51] Int. Cl.[6] ..... E04H 13/00

[52] U.S. Cl. ..... 52/103; 52/294; 248/156; 248/370

[58] Field of Search ..... 52/103, 294, 134, 52/138; 248/156, 370, 910

[56] References Cited

U.S. PATENT DOCUMENTS

| | | | |
|---|---|---|---|
| 734,770 | 7/1903 | Stewart | 52/103 |
| 2,886,963 | 5/1959 | Bergmann . | |
| 3,938,286 | 2/1976 | Mochinski | 52/103 |
| 4,009,547 | 3/1977 | Hood . | |
| 4,019,294 | 4/1977 | Bosico et al. . | |
| 4,051,684 | 10/1977 | Fulkerson et al. | 52/103 X |
| 4,175,363 | 11/1979 | Moskowitz . | |
| 4,185,425 | 1/1980 | Merkel . | |
| 4,403,959 | 9/1983 | Hurlbut | 52/103 |
| 4,550,537 | 11/1985 | Smith . | |
| 5,475,950 | 12/1995 | Polmer | 52/294 X |

FOREIGN PATENT DOCUMENTS

| | | | |
|---|---|---|---|
| 539168 | 3/1922 | France | 52/103 |
| 56489 | 6/1967 | Germany | 52/103 |
| 3045393 | 7/1982 | Germany | 52/103 |
| 6235639 | 8/1984 | Japan | 52/103 |
| 2142949 | 1/1985 | United Kingdom | 52/103 |
| 2280689 | 2/1995 | United Kingdom | 52/103 |

*Primary Examiner*—Wynn E. Wood
*Assistant Examiner*—W. Glenn Edwards
*Attorney, Agent, or Firm*—Collard & Roe, P.C.

[57] ABSTRACT

A method for supporting a tombstone, including the steps of boring a hole into the ground which extends to the vault. A polystyrene column is placed into the hole so that it is supported by the top surface of the vault. A rigid platform is attached to the top of the post to provide a platform on which the tombstone is set. The apparatus according to the invention includes the polystyrene column and a rigid platform made from extruded polystyrene foam insulation. The platform is attached to the post by galvanized nails.

10 Claims, 1 Drawing Sheet

METHOD AND APPARATUS FOR SUPPORTING A TOMBSTONE

BACKGROUND OF THE INVENTION

1. Field of the Invention

The invention relates to a method and apparatus for supporting a tombstone. More particularly, it relates to a polystyrene base for the tombstone which extends below the frost line.

2. The Prior Art

Tombstones or monuments are typically set on a three-foot deep concrete slab. Before pouring the slab, it is necessary to dig a hole of appropriate size and depth, which is a labor-intensive operation usually requiring heavy equipment. Once solidified, the slab forms a stable base for the tombstone which is unaffected by ground heaving due to temperature changes within the ground.

Certain attempts have been made to provide tombstone supports which would overcome the difficult and time-consuming procedure previously employed. An example of these attempts is set forth in the following U.S. Patents:

U.S. Pat. No. 2,886,963 to Bergmann; U.S. Pat. No. 4,009,547 to Hood; U.S. Pat. No. 4,019,294 to Bosico et al.; U.S. Pat. No. 4,175,363 to Moskowitz; U.S. Pat. No. 4,185,425 to Merkel; and U.S. Pat. No. 4,550,537 to Smith.

However, certain of these improvements still require substantial effort during installation. In addition, most of these improvements cannot be easily installed once the gravesite has been filled in after burial.

SUMMARY OF THE INVENTION

Accordingly, it is an object of the present invention to overcome the drawbacks of the prior art and to provide a method and apparatus for supporting a tombstone, which can be simply and easily installed.

It is a further object of the present invention to provide a tombstone support made from lightweight materials which can be readily trimmed to the required dimensions.

These and other related objects are achieved according to the invention by method for supporting a tombstone, including the steps of boring a hole into the ground to extend below the frost line and placing an elongated post into the hole. A rigid platform is attached to the top of the post and the tombstone is set on the platform, whereby the tombstone remains undisturbed by ground heaving due to frost. The hole is bored about six feet into the ground and extends to the top surface of the vault to further support the post. The post is a modified, expanded polystyrene column with resilient closed cells. The platform is made from extruded polystyrene foam insulation.

The invention also relates to an apparatus for supporting a tombstone at ground level. The apparatus includes an elongated post having a top surface and a bottom surface. The post is substantially buried in the ground with the bottom surface positioned below a frost line and a top surface being disposed slightly below ground level. A rigid platform is attached to the top surface of the post for supporting the tombstone at approximately ground level, wherein the tombstone remains undisturbed by ground heaving due to frost. Galvanized nails are used to attach the rigid platform to the top surface of the post.

BRIEF DESCRIPTION OF THE DRAWING

Other objects and features of the present invention will become apparent from the following detailed description considered in connection with the accompanying drawing. It is to be understood, however, that the drawing is designed as an illustration only and not as a definition of the limits of the invention.

In the drawing, wherein similar reference characters denote similar elements throughout the several views.

DETAILED DESCRIPTION OF THE PREFERRED EMBODIMENTS

Figure 1:
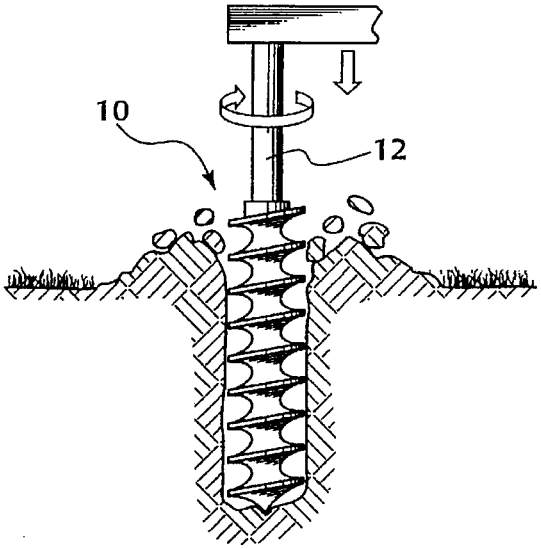
FIG. 1 is a side elevational view of the hole being bored into the ground.
Figure 2:
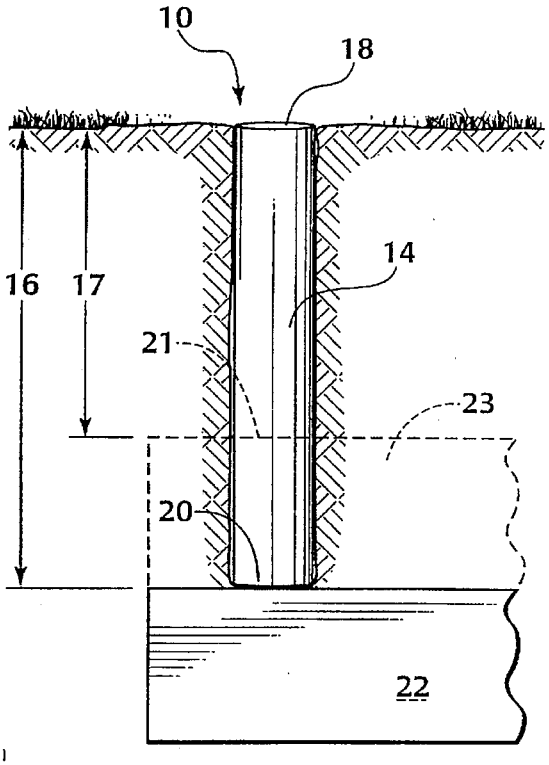
FIG. 2 is a side elevational view showing an elongated post placed into the hole.

Referring now in detail to the drawings and in particular FIG. 1., there is shown a site 10 on which a monument or tombstone is to be placed. The site is prepared by boring a hole with an auger bit 12. After boring to the desired depth, post 14 is set into the hole, as can be seen in FIG. 2. Post 14 has a diameter of 12 inches, for example. Auger bit 12 also has a 12-inch diameter, for example. Post 14 includes a top surface 18 and a bottom surface 20. Upon placement into the hole, top surface 18 should be approximately flush to ground level in the vicinity of site 10. Bottom surface 20 is supported on top of a vault 22.

Vault 22 is buried so that the distance 16 from ground level to the top of vault 22 is approximately six feet deep. The hole for post 14 extends all the way down to the top surface of vault 22. By placing the post 14 directly on top of vault 22, vertical displacement of post 14 is substantially avoided. This adds to the overall stability of the support for the monument. Occasionally, site 10 may be used to bury a second coffin within a second vault 23. Post 14 can be easily removed from the hole so that vault 23 can be buried on top of vault 22. Post 14 is shortened by a distance equal to the height of vault 23. Accordingly, post 14 is provided with a new bottom surface 21 which is supported directly on the top surface of vault 23. In this instance, post 14 extends down a depth 17, for example, 3 feet.

Figure 3:
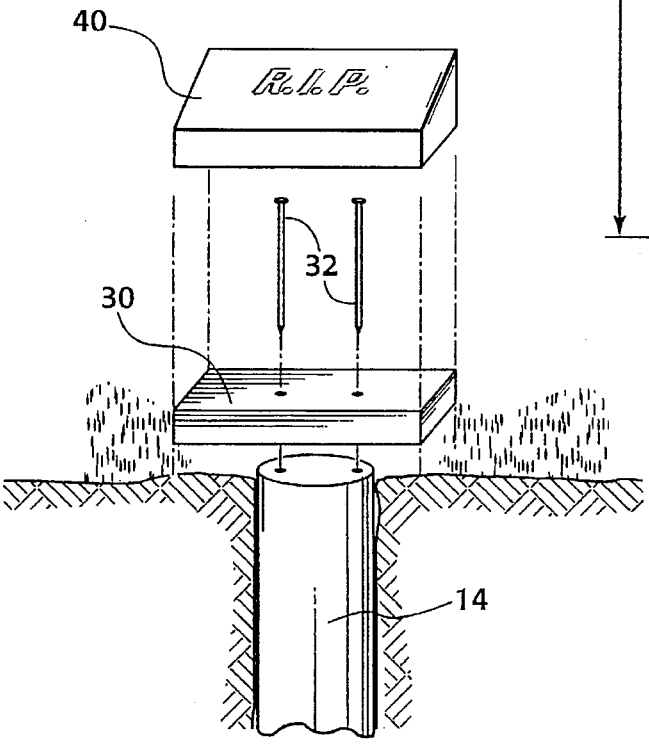
FIG. 3 is a perspective view showing the platform and tombstone mounted onto the post.

As can be seen in FIG. 3, a platform 30 is attached to top surface 18 of post 14 with nails 32 or other suitable attachment means. For example, ten inch (10") galvanized nails may be used. A monument or tombstone 40 then rests on top of platform 30. By virtue of post 14 extending down below the frost line, platform 30 and monument 40 are held in position even during ground heaving resulting from frost. Due to the exact dimensions of auger bit 12 matched to post 14, a perfectly sized hole is quickly and easily bored by one to two workers. Post 14 is made from expanded polystyrene, which is lightweight and can be easily set in place by manually forcing it into the hole. Post 14 is a rigid, foamed plastic with resilient closed cells available under the trade name EPS Insulation. The typical physical properties of EPS Insulation are as follows.

| PROPERTY | UNITS | ASTM TEST | TYPE IX |
|---|---|---|---|
| Density(Maximum) | pcf | | 2.0 |
| Density(Mininum) | pcf | C303 or D1622 | 1.80 |
| Thermal Conductivity @ 40 F. | BTU/(hr.) | C177 or C518 | 0.21 |
| K Factor @ 75 F. | (sq.ft.) (F./in.) | | 0.23 |
| Thermal Resistance @ 40 F. | per inch | — | 4.76 |

-continued

| PROPERTY | UNITS | ASTM TEST | TYPE IX |
|---|---|---|---|
| Values (R)* @ 75 F. | thickness | — | 4.35 |
| Strength Properties | | | |
| Compressive 10% Deformation | psi | D1621 | 25–33 |
| Flexural | psi | C203 | 55–75 |
| Tensile | psi | D1623 | 23–27 |
| Shear | psi | D732 | 33–37 |
| Shear Modulus | psi | — | 600–640 |
| Modulus of Elasticity | psi | — | 460–500 |
| Moisture Resistance | | | |
| WVT | perm.in. | E96 | 0.6–2.0 |
| Absorption (vol.) | % | C272 | less than 2.0 |
| Capillarity | — | — | none |
| Coefficient of Thermal Expansion | in./(in.) (F.) | D696 | 0.00035 |
| Maximum Service Temp. | °F. | — | |
| Long-term | | | 167 |
| Intermittent | | | 180 |
| Oxygen Index | Minimum % | D2863 | 24.0 |
| Dimensional Stability | % Change | D2126 | max. 2.0 |
| Bond Strength, lb/ft$^2$ shear | | | |
| with Portland Cement | | | 830 |
| with gypsum | | | 510 |
| Sound Absorption | | | |
| at 1000 cps | | | 0.36 |
| at 2000 cps | | | 0.54 |
| at 4000 cps | | | 0.38 |
| Buoyancy lb/ft$^3$ | | | 60 |
| Toxicity | | Laboratory Reports | **Note 1 |
| Resistance | | F.H.A. Test Procedures | **Note 2 |

*'R' means resistance to heat flow. The higher the 'R' value, the greater the insulating power.

**Note 1.:
Approx. the same as burning wood, paper or cardboard
**Note 2.:
Will not support bacterial or fungus growth; no food value Platform 30 is a two-inch thick panel of STYROFOAM HI-Brand Earth Insulation. In practical applications, STYROFOAM HI-100 has been successfully used. The other dimensions of platform 30 can be easily cut with a saw or knife to the dimensions of the bottom of monument 40.

Accordingly, while only several embodiments of the present invention have been shown and described, it is obvious that many changes and modifications may be made thereunto without departing from the spirit and scope of the invention.

What is claimed is:

1. A method for supporting a tombstone comprising the steps of:

boring a hole into the ground to extend below the frost line and to a top surface of a vault;

placing an elongated post into the hole such that the post is supported by contacting the top surface of the vault, said post being a modified, expanded polystyrene column with resilient closed cells;

attaching a rigid platform to a top of the post; and setting a tombstone on the platform whereby the tombstone remains undisturbed by ground heaving due to frost.

2. The method according to claim 1, wherein the hole is bored about six (6) feet into the ground.

3. The method according to claim 2, wherein said polystyrene column has a density of at least 1.80 pcf and a compressire strength property of approximately 25 to approximately 33 psi at 10% deformation.

4. The method according to claim 3, wherein the platform is extruded polystyrene foam insulation.

5. The method according to claim 4, wherein said step of attaching comprises:

nailing galvanized nails through the rigid platform into the post to secure the platform to the post.

6. An apparatus for supporting a tombstone at ground level comprising;

an elongated post having a top surface and a bottom surface, said post being a modified, expanded polystyrene column with resilient closed cells substantially buried in the ground with said bottom surface being supported by contacting a top surface of a vault and positioned below a frost line, and said top surface being disposed slightly below ground level; and a rigid platform attached to said top surface of said post for supporting the tombstone at approximately ground level, wherein the tombstone remains undisturbed by ground heaving due to frost.

7. The apparatus according to claim 6, wherein said bottom surface is disposed approximately six (6) feet below ground level.

8. The apparatus according to claim 6, wherein said polystyrene column has a density of at least 1.80 pcf and a compressive strength property of approximately 25 to approximately 33 psi at 10% deformation.

9. The apparatus according to claim 8, wherein the platform is extruded polystyrene foam insulation.

10. The apparatus according to claim 9, further comprising galvanized nails to attach said rigid platform to said post.

* * * * *